US008752323B2

(12) United States Patent
Fulton et al.

(10) Patent No.: US 8,752,323 B2
(45) Date of Patent: Jun. 17, 2014

(54) ADJUSTABLE PISTOL GRIP FOR FIREARMS

(71) Applicants: Dorian Fulton, Las Vegas, NV (US); Michael Jones, San Clemente, CA (US)

(72) Inventors: Dorian Fulton, Las Vegas, NV (US); Michael Jones, San Clemente, CA (US)

(73) Assignee: Gunutz LLC, Las Vegas, NV (US)

( * ) Notice: Subject to any disclaimer, the term of this patent is extended or adjusted under 35 U.S.C. 154(b) by 0 days.

(21) Appl. No.: 13/922,458

(22) Filed: Jun. 20, 2013

(65) Prior Publication Data

US 2013/0340312 A1 Dec. 26, 2013

Related U.S. Application Data

(60) Provisional application No. 61/661,967, filed on Jun. 20, 2012.

(51) Int. Cl.

| | |
|---|---|
| ***F41C 23/00*** | (2006.01) |
| ***F41C 23/14*** | (2006.01) |
| ***F41C 23/10*** | (2006.01) |

(52) U.S. Cl.

CPC ..... *F41C 23/14* (2013.01); *F41C 23/10* (2013.01)

USPC ..... 42/73; 42/75.03

(58) Field of Classification Search

CPC ..... F42C 23/14; F42C 23/10

USPC ..... 42/73, 75.03

See application file for complete search history.

(56) References Cited

U.S. PATENT DOCUMENTS

| | | | | |
|---|---|---|---|---|
| 4,300,302 | A | 11/1981 | Anschutz et al. | |
| 4,630,387 | A | 12/1986 | Crane et al. | |
| 4,884,354 | A * | 12/1989 | Senfter | 42/73 |
| 7,941,956 | B2 * | 5/2011 | Carr et al. | 42/73 |
| 8,033,274 | B2 * | 10/2011 | Pedemonte | 124/20.3 |

* cited by examiner

*Primary Examiner* — J. Woodrow Eldred

(74) *Attorney, Agent, or Firm* — Cermak Nakajima LLP; Adam J. Cermak

(57) ABSTRACT

An adjustable pistol grip for improving the accuracy of detachable pistol grip firearms, including rifles, improves the ergonomics for the trigger and pistol grip. The pistol grip is user-adjustable and useable for a larger range of hand sizes. The improvement to provide adjustability allows for proper hand and finger positioning providing improved trigger control to the user.

15 Claims, 5 Drawing Sheets

STATIONARY HANDLE

ADJUSTABLE HANDLE:
SAW TOOTH

ADJUSTABLE HANDLE: SAW TOOTH

ADJUSTABLE HANDLE: JACK SCREW

ADJUSTABLE HANDLE:
JACK SCREW

ADJUSTABLE PISTOL GRIP FOR FIREARMS

This application is claims priority under 35 U.S.C. §119 to U.S. Provisional App. No. 61/661,967, filed 20 Jun. 2012, by the inventors herein, the entirety of which is incorporated by reference herein.

BACKGROUND

1. Field of Endeavor

The invention relates to improved grips to accommodate various hand sizes for popular pistol grip firearms, including rifles such as AR10/AR15/M4/M16, AK47/74, H&K, and Barrett rifles and all other rifles, handguns, and firearms with detachable pistol grips.

2. Brief Description of the Related Art

One of the most widely used rifles available today is the AR15 civilian variant of the M16 service rifle. One of the remarkable features of the AR15 is that virtually anyone can shoot it. It is light in weight and, due to the gas reloading system, the gun has very little recoil. This has made it extremely popular. In its current design, the gun is modular and numerous accessories have been made for customizing the gun to the individual shooter.

A few examples include: sights can be added or changed to accommodate different shooting scenarios; flat top receivers are available for mounting optics to improve distance shooting; and rails can be added to hold accessories such as bipods, lasers, and flashlights on the basic gun to suit an individual's desire.

Notably, one of the most widely available features is modified pistol grips. These have various angle of rake, size of handles, compartments, padding, textures, and rubber sleeves.

A sizeable industry has developed around supplying numerous accessories for this series of rifles.

Accuracy, the consistent delivery of a bullet to exactly the point desired, is a valuable attribute to all shooters. It is a matter of great consequence to hunters and competitors, and it is literally a matter of life and death to military and law enforcement shooters.

Generally, the more accurate a weapon, the more valuable and useful it is. Because of this, improving accuracy is a never-ending quest that fuels multiple businesses and extensive research and development globally.

Accuracy can be affected by controllable and uncontrollable factors. Wind, rain, and obstacles are some examples of uncontrollable factors.

Controllable factors are continuously and extensively studied. There is an unrelenting drive to improve every controllable factor in accuracy throughout civilian and military organizations, academia and business.

The US Army conducted a survey and published results on hand size distributions in December 1991. Data is published for measurement (17), Digit 2 Link Length, which is the length from the tip of the index finger to the center of the palm (table attached). This measurement is a reasonable representation of the problem confronted by devices embodying principles of the present invention, and the problem existing on the AR15 specifically. The range in this measurement is 3.34 to 4.60 inches in females and 3.364 to 4.92 in males. Thus, to cover the entire population, a device has to accommodate a range of 1.58 inches. The inventors' personal measurements of this length are 4.58 and 4.82 inches.

A useful analogy may be drawn using gloves: fitting the grip and trigger is like trying to find the right glove for one's hand. If one is trying on knit gloves, the issue is easily addressed by the stretchy nature of knit fabrics. If, however, one is trying on leather gloves, even very soft ones, this becomes a highly specific fitting session. In order for a leather glove to work properly, it must be very closely sized to the individual's hand that is using it. A poor fit is a significant problem.

Devices embodying principles of the present invention are intended to accommodate even the largest hands. Currently the AR15 standard pistol grip has a length of approximately 2⅛ inches between the trigger surface and the back of the pistol grip. The inventors herein estimate that approximately 80 percent of females and 35 percent of males will have this produce a comfortable position for optimized accurate shooting. This leaves the hands of 65% of men and 20% of females in a non-optimum position, which would benefit from an adjustable pistol grip.

Assume that this target population would like to shoot accurately. Because proper trigger control is a skill that is controllable by the shooter, and it is considered of paramount importance in getting an accurate shot, there are a number of granted U.S. patents for a variety of ergonomic and mechanical devices to improve the shooter's ability to apply skill to shooting and to minimize error introduced through poor fit or function.

When the sights are properly aligned and the trigger is squeezed, any movement of the barrel will introduce an error and reduce accuracy. In hunting and competition, this is ruinous; in military and law enforcement it can be catastrophic.

SUMMARY

According to a first aspect of the invention, an apparatus useful for mounting to the receiver of a firearm having a pistol grip and a trigger comprises an adjustable pistol grip configured and arranged for mounting to the receiver, the pistol grip being longitudinally moveable towards and away from the trigger on the firearm to allow a shooter optimal positioning of the shooter's hand for controlling the trigger.

According to another aspect of the present invention, a method of positioning a pistol grip on a firearm, the firearm including a portion configured to receive a portion of the pistol grip so that the pistol grip is firmly mounted to said firearm portion, comprises positioning a mounting block on said firearm portion; and attaching a longitudinally adjustable pistol grip to said mounting block.

Still other aspects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

A general architecture that implements the various features of the invention will now be described with reference to the drawings. The drawings and the associated descriptions are provided to illustrate embodiments of the invention and not to limit the scope of the invention. Throughout the drawings, reference numbers are re-used to indicate correspondence between referenced elements

FIG. 2B illustrates a side section view of a standard AR15 receiver, notched interface pistol grip, pistol grip mounting block, and attachment screws and.

DETAILED DESCRIPTION OF EXEMPLARY EMBODIMENTS

Figure 1B:
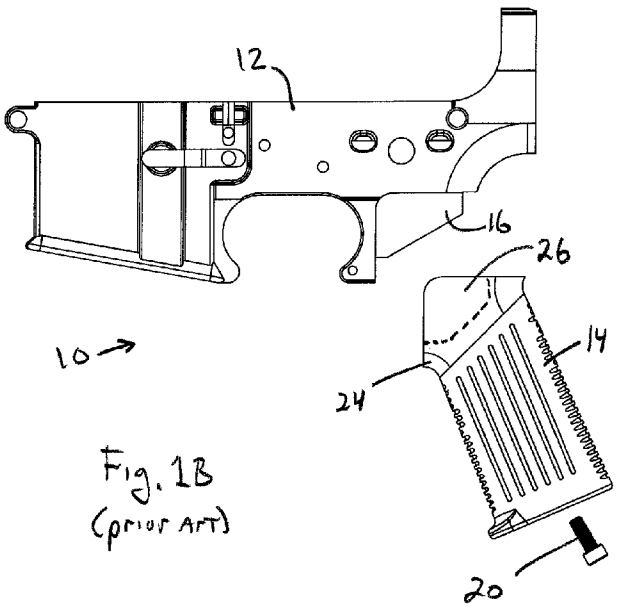
Fig. 1B (prior art)
FIG. 1B illustrates an exploded side view of a standard AR15 lower receiver, pistol grip, and pistol grip attachment screw.

Referring to the drawing figures, like reference numerals designate identical or corresponding elements throughout the several figures.

The singular forms "a," "an," and "the" include plural referents unless the context clearly dictates otherwise. Thus, for example, reference to "a screw" includes reference to one or more of such screws, and reference to "the handle" includes reference to one or more of such handles.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited.

For example, a range of 1 to 5 should be interpreted to include not only the explicitly recited limits of 1 and 5, but also to include individual values such as 2, 2.7, 3.6, 4.2, and sub-ranges such as 1-2.5, 1.8-3.2, 2.6-4.9, etc. This interpretation should apply regardless of the breadth of the range or the characteristic being described, and also applies to open-ended ranges reciting only one end point, such as "greater than 25," or "less than 10."

One of numerous aspects of the invention enables a pistol-gripped rifle shooter to adjust the rifle so that s/he can properly position his finger on the trigger based on his hand size, markedly improving a crucial ergonomic feature, so that can improve his "trigger control" and thus his accuracy.

What is apparent is that the adjustability of the gun to the shooter can be highly tailored and in virtually every other feature, except pistol grips, the adjustments can be very fine, down to thousandths of an inch. In pistol grips, particularly for AR and AK rifles, the original pistol grip is so close to the trigger that a small woman or girl with a very small hand can grip and fire the weapon comfortably. At the same time a large-handed man can fire the weapon, but has to bend his finger to reach back to get to the trigger. Aftermarket grips are widely available, but they are all fixed in place and bolted to the bottom of the AR15 receiver. Plainly stated, the only adjustability is with a larger diameter grip, or a sleeve that is placed over the grip. This leads to only a few options for sizing the pistol grip to the shooter.

Another aspect includes a device that can significantly improve a shooter's ability to shoot accurately, by providing virtually infinite adjustability to a key controllable component of accuracy—ergonomics—and therefore provide a quantum improvement in operator skill through enabling significantly improved "trigger control".

Yet another aspect includes a device which is designed to improve the ergonomic relationship of the shooter's trigger hand to the trigger so that every shooter can adjust his trigger finger to precisely rest on the trigger in a manner that optimizes his ability to shoot accurately.

Currently all shooters, on all rifles that possess an attachable pistol grip, must conform their hands to the fixed positions of the grip and trigger.

All pistol grip featured rifles are sized to fit the smallest adult hand and can be comfortably operated (grasped and properly triggered) by children. The bulk of shooters are adult males and this large population must currently conform their grip and trigger operation to an absurdly mis-positioned set of controls.

Numerous attempts have been made to provide adjustability to the vast range of hand sizes of shooters, (again, using the glove analogy, gloves commonly come in sizes ranging from Women's Small to Men's Extra Large) to the currently compulsory positions of trigger and grip. These all involve changes to the shape of the grip, or the angle of the grip, but only minutely address the true issue: the distance between the trigger and the grip.

Devices embodying principles of the present invention can provide an incremental or infinitesimal adjustment of the pistol grip relative to the trigger to allow for various hand sizes to get into proper position to accomplish trigger control for accurate shooting.

The following description of an exemplary embodiment of an adjustable pistol grip for a firearm is presented with application to a rifle with a pistol grip, and more particularly, to an AR-15. The subject matter of this application is, however, applicable to any firearm that has a removable pistol grip, including pistols. Furthermore, while the drawings have been simplified by not illustrating portions of an AR-15 that are not immediately involved with adjustable pistol grips as described herein, those of skill in the art readily appreciate that such rifles include many additional components, including an upper receiver, bolt carrier, bolt, butt stock, receiver extension, trigger assembly, etc., and all of their associated subcomponents. Similarly, while a pistol firearm is not illustrated, the application of an adjustable pistol grip as described herein to a pistol firearm is also part of this description. An AR-15 is currently commercially available from numerous manufacturers, including, but not limited to, Bushmaster Firearms International model XM-15 (Madison, N.C.) and Remington Arms model R-15 (Madison, N.C.).

In general terms, an exemplary adjustable pistol grip embodying principles of the present invention includes a mounting block which is attached, e.g., bolted to the rifle receiver with a screw or bolt, with a moveable pistol grip extending from the mounting block and a bolt or screw to lock the position of the pistol grip relative to the mounting block. The moveable handle is positioned on the mounting block in the desired position for the individual shooter to establish comfortable positioning of his trigger finger on the rifle trigger. As this is a highly individualized position, this must be adjustable. Advantageously, yet still optionally, the adjoining surfaces of the mounting block and the pistol grip can have non-flat, complementary, interlocking surfaces, e.g., mating sawteeth, square teeth, or the like.

In another exemplary embodiment, the adjustable pistol grip includes a mounting block which is bolted to the rifle receiver with a screw or bolt, with a moveable pistol grip extending from the mounting block and a jack screw to adjust and lock the position of the pistol grip relative to the mounting block. The moveable pistol grip is positioned on the mounting block in the desired position for the individual shooter to establish comfortable positioning of his trigger finger on the rifle trigger. The jack screw mates with a correspondingly threaded portion of the movable pistol grip or the mounting block translates the rotation of the jack screw into linear movement of the structure in which the correspondingly threaded portion is formed.

Figure 1A:
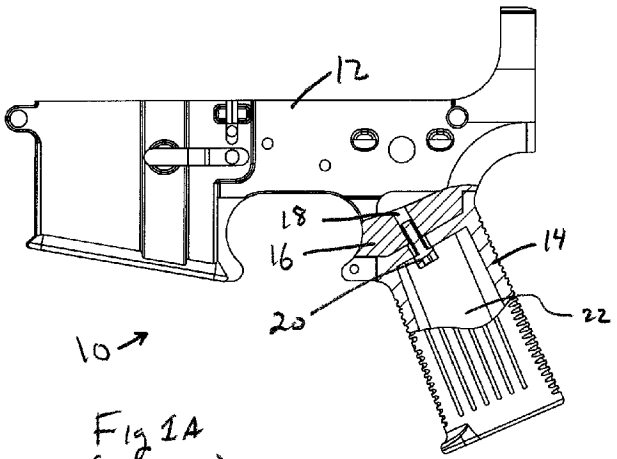
Fig. 1A (prior art)
FIG. 1A illustrates a side section view of a standard AR15 lower receiver, pistol grip and pistol grip attachment screw.
Figure 1C:
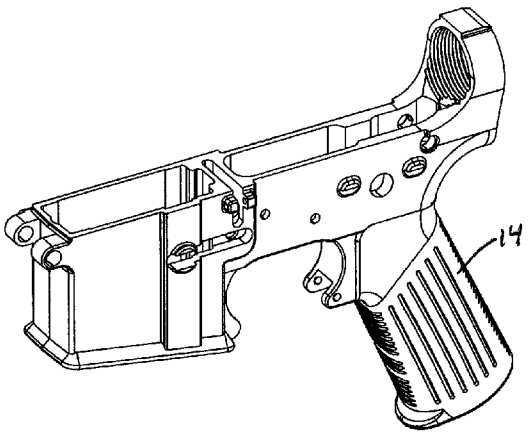
Fig. 1C (prior art)
FIG. 1C illustrates an isometric view of a standard AR15 receiver, pistol grip.
Figure 2C:
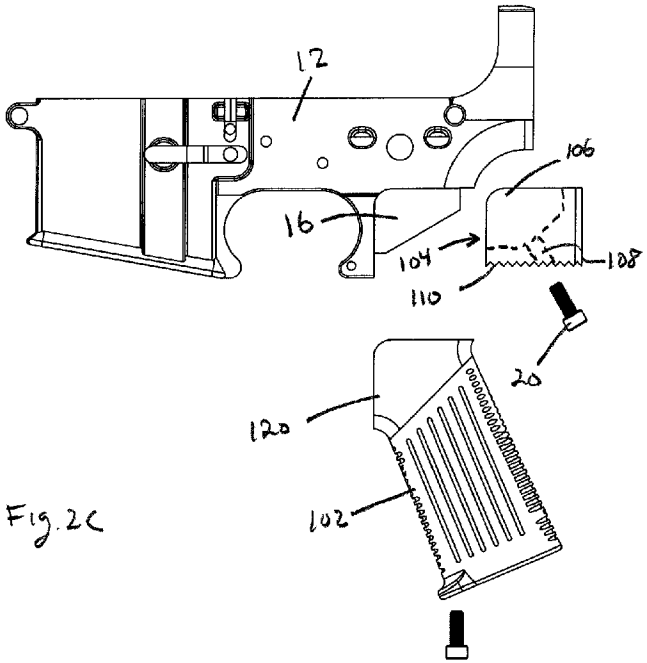
FIG. 2C illustrates an exploded side view of a standard AR15 receiver, notched interface pistol grip, pistol grip mounting block, and attachment screws.
Figure 2B:
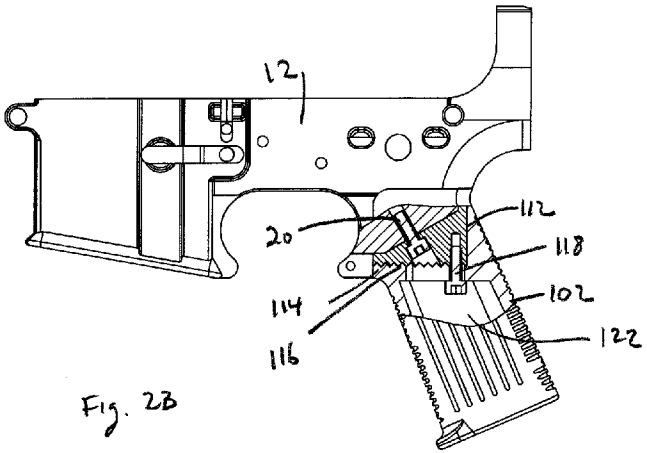
Figure 2A:
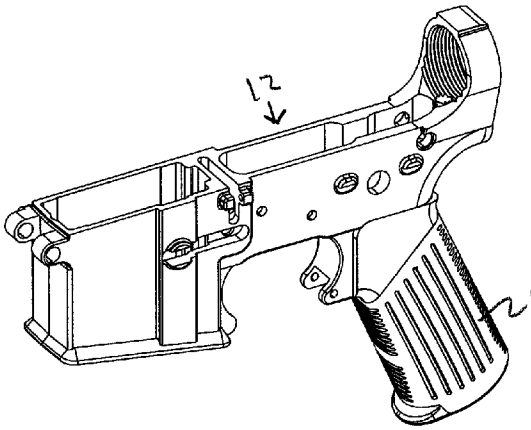
FIG. 2A illustrates an isometric view of a standard AR15 receiver, and notched interface pistol grip embodying principles of the present invention. From a cursory view this appears identical to FIG. 1C.
Figure 2E:
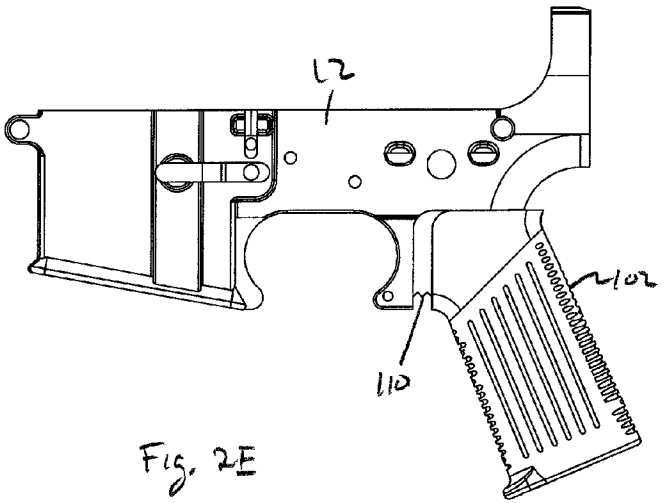
FIG. 2E illustrates a side view of a standard AR15 receiver and notched interface pistol grip in a mid-length position. This lengthens the distance from the trigger for moderate sized hands.
Figure 2D:
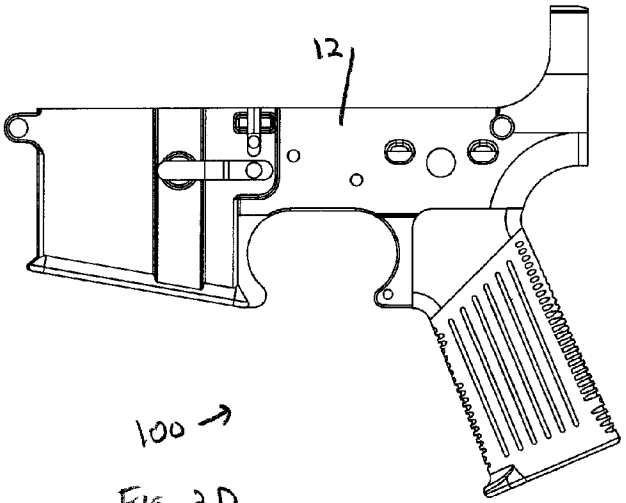
FIG. 2D illustrates a side view of a standard AR15 receiver and notched interface pistol grip in the standard position.
Figure 2F:
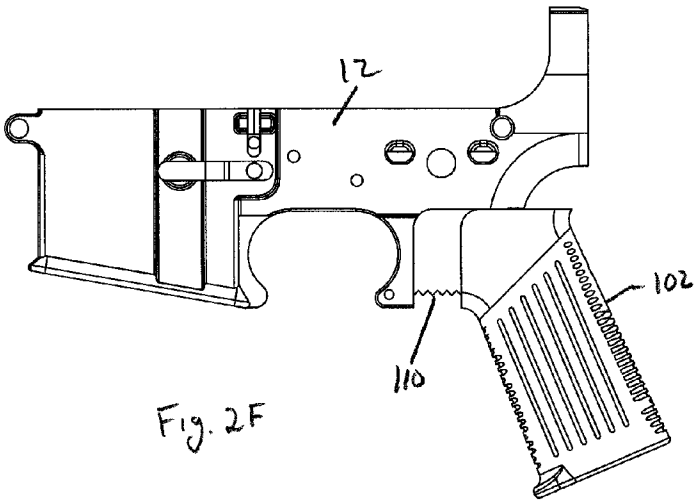
FIG. 2F illustrates a side view of a standard AR15 receiver, notched interface pistol grip in the longest position. This lengthens the distance from the trigger for large sized palms or long fingers or combinations of these features.

Turning now to the drawing figures, FIG. 1, including FIGS. 1A-1C, illustrates portions 10 of a currently available AR-15. A lower receiver 12 includes a typical space for a trigger assembly (not illustrated), and a pistol grip 14 which is mounted to a flange 16 that extends from a lower side of the receiver 12. The flange 16 includes a threaded bore 18, into which a correspondingly threaded screw or bolt 20 mounts the grip 14, the bolt 20 having been inserted through a hollow space or bore 22 in the pistol grip 14. As can be seen in FIG. 1B, the pistol grip 14 is separable from the lower receiver 12, exposing the flange 16. As described and illustrated elsewhere herein, the pistol grip 14 includes an internal slot 26 or other recess in an upper portion 24 which is adapted, sized, and configured to receive the flange 16 so that, when the grip 14 is secured to the lower receiver 12 with the bolt 20, a firm connection is made. As discussed elsewhere herein, the spacing of the pistol grip 14 from the space on the lower receiver 12 in which the trigger is located is fixed and not adjustable.

FIG. 2, including FIGS. 2A-2F, illustrates a first exemplary embodiment of an adjustable pistol grip 100 embodying principles of the present invention. Because adjustable pistol grips as described herein do not require modification of the existing firearm structures to which the original pistol grip was mounted, the lower receiver 12 includes the same structures as described with reference to FIG. 1 and the trigger assembly is in a known location. The adjustable pistol grip 100 includes a pistol grip 102 which can be, in many ways, identical to the grip 14. A mounting block 104, which connects together the lower receiver 12 and the grip 102, includes an internal slot 106 which is adapted, sized, and configured to receive the flange 16 of the lower receiver 12. For embodiments of a firearm in which these structures are reversed (e.g., the lower receiver includes a slot, and the grip includes a flange), the block 104 includes the mating structure. A bolt bore 108 extends through the block 104, similar to bore 18.

The lower surface of the mounting block 104 includes at least one, and advantageously a plurality, of teeth 110, which can have any cross-sectional shape. Correspondingly, the upper portion of the grip 102 includes an interior cavity 112, sized to receive the mounting block 104 therein, and the upwardly facing surface 114 that defines the cavity 112 includes at least one, and advantageously a plurality of teeth 116 that are sized and shaped to mate with the teeth 110. A mounting bolt 118 secures the grip 102 to the mounting block 104, accessible via a cavity, bore, or the like, in the grip 102. The upper portion 120 of the grip includes an internal space sized to receive the mounting block 104 therein, similar to slot 22, although larger in preferred embodiments so that the flange 16 does not need to be modified.

With continued reference to FIG. 2, particularly FIGS. 2B and 2D-2F, the longitudinal spacing of the grip 102 from the trigger assembly, and the rest of the lower receiver's subcomponents that have fixed positions, can be adjusted to the shooter's desires. The mounting block 104 is secured to the flange 16 with bolt 118. Then, the grip 102 is placed over the mounting block 102, with the block being housed in the cavity in upper portion 120, and the tooth or teeth 110 mating with the tooth or teeth 116, and the bolt 118 is positioned to secure the grip 102 to the mounting block. If the longitudinal spacing of the grip 102 relative to the trigger assembly is not to the shooter's liking, the bolt 118 is removed, the grip moved longitudinally forward or backward into a new configuration (FIGS. 2E, 2F), with the teeth 110, 116 mating, and the bolt replaced, securing the adjustable grip 100 to the lower receiver 12 in a configuration that better matches the shooter's hand's size.

Figure 3A:
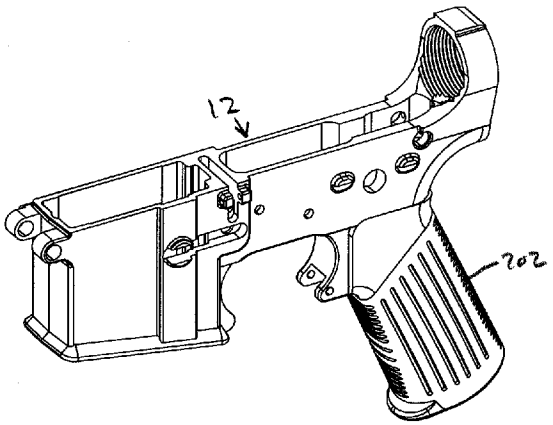
FIG. 3A illustrates an isometric view of a standard AR15 receiver, and a jack screw interface pistol grip embodying principles of the present invention. From a cursory view this appears identical to FIG. 1C.
Figure 3B:
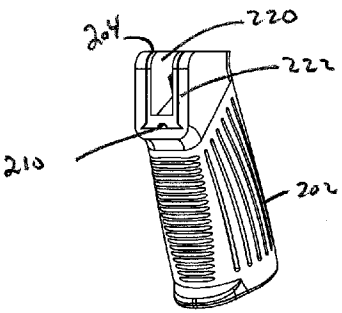
FIG. 3B illustrates an isometric view of the jack screw interface pistol grip, and the mounting block to the AR15 receiver, including a dovetail interface between the two parts to aid in stability.
Figure 3C:
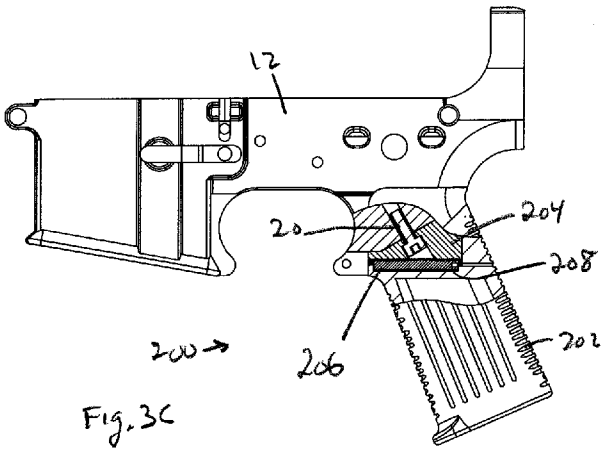
FIG. 3C illustrates a side section view of the AR15 receiver, jack screw interface pistol grip, the mounting block to the AR15 receiver. Also shown are the jack screw and the attachment screw.
Figure 3D:
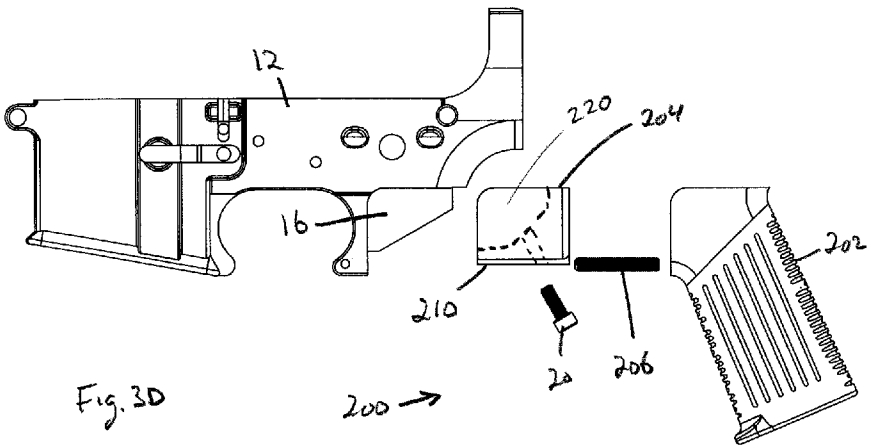
FIG. 3D illustrates an exploded side view of the AR15 receiver, jack screw interface pistol grip, the mounting block to the AR15 receiver. Also shown are the jack screw and the attachment screw.
Figure 3F:
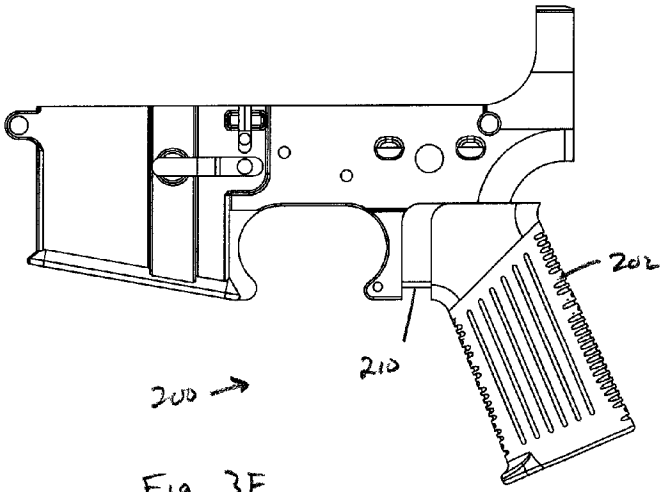
FIG. 3F illustrates a side view of a standard AR15 receiver, and the jack screw pistol grip, in a mid-length position. This lengthens the distance from the trigger for moderate sized hands.
Figure 3E:
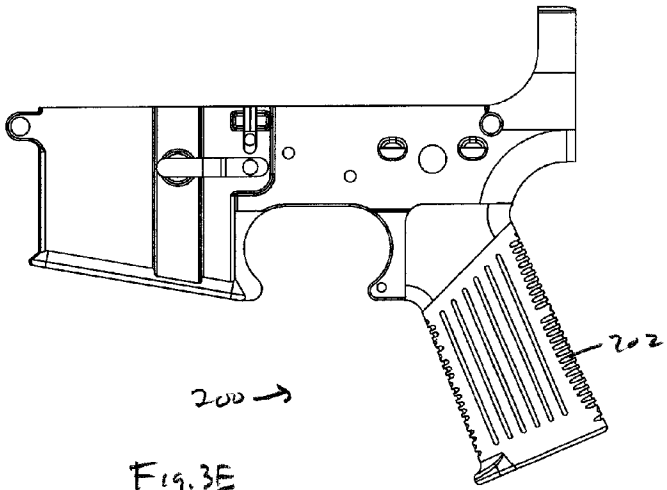
FIG. 3E illustrates a side view of a standard AR15 receiver, and the jack screw pistol grip, in the standard position.
Figure 3G:
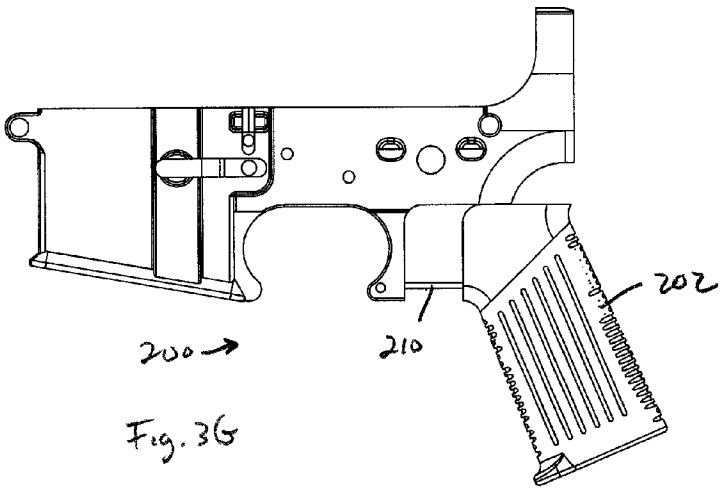
FIG. 3G illustrates a side view of a standard AR15 receiver, and the jack screw pistol grip, in the longest position. This lengthens the distance from the trigger for large sized palms or long fingers or combinations of these features

FIG. 3, including FIGS. 3A-3G, illustrates several views of another exemplary embodiment of an adjustable pistol grip 200. The adjustable pistol grip 200 includes a pistol grip 202, a mounting block 204 (similar in some respects to mounting block 104), and a jack screw 206 which longitudinally adjusts the relative longitudinal position of the grip to the lower receiver 12. The jack screw 206 is positioned in a partial bore 210, or other similar space, formed between the mounting block 204 and the top surface of an internal slot 222 formed in the grip 202 (see FIG. 3B), and is free to rotate therein without longitudinal motion. Either the mounting block 204, on its lower surface, which delimits the upper portion of the bore 210, or the top surface 208 of the grip 202, which delimits the lower portion of the bore 210, includes a thread, detent, or the like, which is sized and adapted to mate with the threads on the jack screw 206. One or both ends of the jack screw 206 are accessible from outside the grip 202 through an access hole or the like (not illustrated), so that a driver (e.g., screwdriver) can be used to rotate the jack screw in the bore 210. Because the jack screw 206 cannot move longitudinally in the bore 210, and because the threads of the jack screw mate with a corresponding thread, detent, or the like on either the grip 202 or the mounting block 204, rotation of the jack screw is therefore translated into longitudinal motion of the grip 202 relative to the flange 16 and the receiver 12. As can be seen in FIG. 3B, the grip 202 includes a dovetail mating structure, or similar configuration, between the mounting block 204 and the grip, so that the mounting block and grip can move longitudinally relative to each other which still being fixed in the other directions. Once a longitudinal configuration of the mounting block 204 and grip 202 are established, by appropriate rotation of the jack screw 206, the grip 202 can optionally be bolted to the mounting block 204 using one or more screws (similar to screw 118) into a longitudinal slot formed in the mounting block (not illustrated).

According to yet another exemplary embodiment (not illustrated), a rack is formed integral with, or fixedly mounted to, the pistol grip, and a pinion is positioned in the mounting block. As the pinion is turned, e.g., through a hole in the grip using a screwdriver, the pistol grip is moved longitudinally relative to the mounting block. A lock ring or strong adhesive could be used to lock the position and prevent further rotation of the pinion.

According to yet another exemplary embodiment, a square or dovetail groove interface can be provided between the pistol grip and the mounting block. When the desired longitudinal position is achieved, set-screws (such as screw 118) can be tightened to lock the position of the pistol grip relative to the mounting block.

According to yet another exemplary embodiment, a hydraulic or pneumatic cylinder could be used to position the pistol grip relative to the mounting block. A hydraulic cylinder would be preferred, as it would be incompressible and therefore non-moveable; filling this cylinder, located inside the grip, with water, oil, or hydraulic fluid would provide an infinitely fine adjustment along the range of travel of the cylinder. Detaching a filling syringe or pump from a fill port located on the exterior of the grip, with an integral closing valve, would lock the fluid volume in the cylinder and fix the location of the pistol grip.

According to yet another exemplary embodiment, a heat deformable linkage can be included between the flange 16 and a pistol grip. The heat deformable link could be made from a thermoplastic or malleable metal that is heated to soften the link. The user then positions the pistol grip in the desired longitudinal location and then the linkage is allowed to cool, locking the position of the handle relative to the mounting block.

In each exemplary embodiment, in order to accommodate a significant range of sizes of human hands, the adjustable pistol grip has a range of motion from 2.09 to 3.25 inches between the trigger and a rear of the pistol grip. Advantageously, the pistol grip is configured and arranged for incremental adjustment between 1/16 to 3/32 of an inch, more preferably between 1/32 to 1/8 inch, even more preferably 0.001 inch and 0.01 inch, and most advantageously continuous adjustment.

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. An apparatus useful for mounting to the receiver of a firearm having a pistol grip and a trigger, the apparatus comprising:

an adjustable pistol grip configured and arranged for mounting to the receiver, the pistol grip being longitudinally moveable towards and away from the trigger on the firearm to allow a shooter optimal positioning of the shooter's hand for controlling the trigger.

2. An apparatus according to claim 1, in which the firearm has a flange to which a standard pistol grip can be attached, the apparatus further comprising:

a mounting block having a slot configured to receive the flange therein, the mounting block including a first mating structure;

wherein the adjustable pistol grip includes a cavity sized to receive the mounting block therein, and a second mating structure configured to mate with the first mating structure and prevent relative longitudinal movement between the mounting block and the adjustable pistol grip.

3. An apparatus according to claim 2, wherein the first and second mating structures together comprise a plurality of interlocking teeth.

4. An apparatus according to claim 2, wherein one of the first and second mating structures includes only a single tooth.

5. An apparatus according to claim 2, wherein said flange includes a threaded bore, and the apparatus further comprising:

a mounting bolt extending through the mounting block, for attachment to the flange at the threaded bore; and a fixation device attaching the adjustable pistol grip to the mounting block, positioned partially in the adjustable pistol grip.

6. An apparatus according to claim 1, in which the firearm has a flange to which a standard pistol grip can be attached, the apparatus further comprising:

a mounting block having a slot configured to receive the flange therein, wherein the adjustable pistol grip includes a cavity sized to receive the mounting block therein;

a jack screw positioned between the mounting block and the adjustable pistol grip, the jack screw including an external thread, the jack screw being freely rotatable and longitudinally fixed relative to the mounting block; and a mating structure on one of the mounting block and the adjustable pistol grip, the mating structure being positioned and configured to mate with the jack screw external thread such that rotation of the jack screw causes relative longitudinal movement between the mounting block and the adjustable pistol grip.

7. An apparatus according to claim 6, further comprising:

a slide connection between the mounting block and the adjustable pistol grip, oriented so that the mounting block and the adjustable pistol grip can slide longitudinally relative to one another, while preventing other relative motion.

8. An apparatus according to claim 7, wherein said slide connection comprises a dovetail connection or a square groove connection.

9. An apparatus according to claim 6, further comprising:

a bore formed between a lower surface of the mounting block and an upper surface of the adjustable pistol grip, wherein the jack screw is positioned in said bore.

10. The apparatus according to claim 1, wherein the adjustable pistol grip is configured and arranged for incremental adjustment.

11. The apparatus according to claim 1, wherein the adjustable pistol grip is configured and arranged for continuous adjustment.

12. A firearm comprising:

a lower receiver having a trigger and a flange to which a pistol grip can be mounted; and an adjustable pistol grip according to claim 1 mounted to said flange.

13. The firearm according to claim 12, wherein the adjustable pistol grip has a range of motion from 2.09 to 3.25 inches between the trigger and a rear of the adjustable pistol grip.

14. A method of positioning a pistol grip on a firearm, the firearm including a portion configured to receive a portion of the pistol grip so that the pistol grip is firmly mounted to said firearm portion, the method comprising:

positioning a mounting block on said firearm portion;

attaching a longitudinally adjustable pistol grip to said mounting block to allow a shooter optimal positioning of the shooter's hand for controlling the trigger.

15. A method according to claim 14, wherein said longitudinally adjustable pistol grip comprises an adjustable pistol grip according to claim 1.

* * * * *